US006007647A

United States Patent [19]

Burns et al.

[11] Patent Number: 6,007,647

[45] **Date of Patent: *Dec. 28, 1999**

[54] AUTOIGNITION COMPOSITIONS FOR INFLATOR GAS GENERATORS

[75] Inventors: Sean P. Burns, Auburn Hills; Larry A. Moquin, Novi, both of Mich.

[73] Assignee: Automotive Systems Laboratory, Inc., Farmington Hills, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/906,496

[22] Filed: Aug. 5, 1997

Related U.S. Application Data

[63] Continuation-in-part of application No. 08/700,681, Aug. 16, 1996, abandoned.

[51] Int. Cl.[6] ..... C06B 31/00

[52] U.S. Cl. ..... 149/36; 149/45; 149/61; 149/62

[58] Field of Search ..... 149/36, 61, 45, 149/62

[56] References Cited

U.S. PATENT DOCUMENTS

| | | | |
|---|---|---|---|
| 3,862,866 | 1/1975 | Timmerman et al. | 149/21 |
| 4,369,079 | 1/1983 | Shaw | 149/61 |
| 4,561,675 | 12/1985 | Adams et al. | 280/734 |
| 5,035,757 | 7/1991 | Poole | 149/46 |
| 5,084,118 | 1/1992 | Poole | 149/22 |
| 5,139,588 | 8/1992 | Poole | 149/61 |
| 5,197,758 | 3/1993 | Lund et al. | 280/741 |
| 5,380,380 | 1/1995 | Poole et al. | 149/22 |
| 5,386,775 | 2/1995 | Poole et al. | 102/289 |
| 5,460,668 | 10/1995 | Lyon | 149/61 |
| 5,460,671 | 10/1995 | Khandhadia | 149/109.6 |
| 5,472,647 | 12/1995 | Blau et al. | 264/3.1 |
| 5,500,059 | 3/1996 | Lund et al. | 149/61 |
| 5,501,823 | 3/1996 | Lund et al. | 264/3.1 |
| 5,661,261 | 8/1997 | Ramaswamy et al. | 149/36 |

*Primary Examiner*—Edward A. Miller
*Attorney, Agent, or Firm*—Lyon, P.C.

[57] ABSTRACT

An autoignition composition for the gas generator of a vehicle occupant restraint system that is thermally stable at temperatures up to 110° C., autoignites between 150° C. and 175° C., produces minimal toxic gases upon combustion, provides for a reduced gas inflator size, and can be safely produced using simple processing methods. By mixing an alkali metal nitrite with a nitrogen-based fuel, the resulting gas generants autoignite at or below 175° C. The addition of an alkaline earth metal nitrite or nitrate provides the stability needed to additionally function as a booster and/or a gas generant.

6 Claims, 1 Drawing Sheet

AUTOIGNITION COMPOSITIONS FOR INFLATOR GAS GENERATORS

CROSS-REFERENCE TO RELATED APPLICATION

The present application is a continuation in part of U.S. patent application Ser. No. 08/700,681, filed on Aug. 16, 1996 now abandoned.

BACKGROUND OF THE INVENTION

The present invention relates to autoignition compositions used in inflator bags of automobile passenger-restraint devices.

In the event of a fire during shipment of a passenger-restraint device, the potential rupture of the pressure vessel is a serious safety concern that has been addressed through utilization of an autoignition compound. When the gas inflator is exposed to fire, the autoignition compound is used to ignite the gas generant of the inflator, thereby preventing rupture and scattered fragmentation of the metallic pressure vessel. Several problems have become apparent when designing an autoignition compound. Although the prior art individually addresses the problems, no autoignition composition has yet provided a combined solution to the various design considerations.

Steel canisters are commonly used as the inflator pressure vessel in a passenger-restraint system because of the relatively high strength of steel at elevated temperatures. Given the emphasis on vehicle weight reduction, it is desirable that metals such as aluminum, and smaller or lighter steel vessels be utilized in the pressure vessel.

Engineering considerations require that vehicle operator restraint systems pass a "bonfire" test, wherein the inflator system is evaluated during exposure to fire. In the past, this has only been a concern for inflator canisters made of aluminum as the current steel pressure vessels routinely pass this test. Aluminum loses strength rapidly with increasing temperature, and may not be able to withstand the combination of increased ambient temperatures and excessive internal temperature and pressure generated upon combustion of the gas generant. An autoignition temperature of 175° C. or less is considered autoignition temperature of 175° C. or less is considered sufficient for the safe use of aluminum canisters.

Although steel pressure vessels do not lose strength as rapidly as aluminum vessels at temperatures above ambient, it is still necessary to ignite and burn the gas generant at a similar temperature due to the high internal pressures created by ignition of the gas generant at high temperatures. At temperatures above 110° C., the possible melting of the fuel component(s) of a mixture as well as the rapid ignition of common gas generants will occur due to high temperatures. The inflator must be designed to maintain its structural integrity despite the high pressures produced by a rapidly burning gas generant. If the gas generant of the inflator can be made to autoignite at relatively low temperatures, for example, 150° C. to 175° C., then the pressure vessel can be made of a lightweight metal.

Another concern is that many nonazide gas generant compositions do not meet the gaseous effluent requirements met by current azide based inflators. The autoignition material, a fraction of the total gas generant, has been found to create excessive levels of undesirable gaseous effluents, particularly carbon monoxide and nitrogen oxides. If an autoignition composition can be developed that produces little or no noxious gases, then the nonazide autoignition compositions will conform more closely to the effluent levels currently achieved by azide fuels.

A further concern involves the industry drive to reduce the size of the inflator by eliminating or reducing the volume of its components. Most inflator systems are deployed by the combustion of a gas generant composition comprising a booster, an autoigniter, and a main gas generant charge. In the event of a collision, electrical initiation of a squib ignites the booster that in turn supplies sufficient energy to ignite the main gas generant charge thereby deploying the gas inflator.

Alternatively, in the absence of an accident, but in the event of a fire during shipment, a separate autoignition composition is placed in close proximity to the booster so that booster and deploying the gas inflator. The booster and autoigniter are separate auxiliary components to the main gas generant, and as such, prior compositions have not significantly contributed to the overall gas generated.

The use of separate booster and autoignition components is problematic for several reasons. Not only does this complicate the manufacturing process by including an additional sub-process and step, but the installation of a separate autoignition cup sub-assembly is also required. Furthermore, using separate autoignition and booster chemical compositions inhibits design flexibility and increases the gas inflator volume.

The hazardous and complicated nature of processing the generant compositions due to their inherent sensitivity to impact and shock presents yet another concern. Often, a component of the mixture is highly explosive leading to further processing precautions. If an autoignition composition were provided without these disadvantages, simplified processing methods such as dry grinding and pelletizing could be used.

DESCRIPTION OF THE RELATED ART

Commonly owned U.S. Pat. No. 5,035,757 and U.S. Pat. No. 5,139,588 to Poole describe azide-free gas generant compositions that form solid "clinkers" thereby providing easily filterable combustion gases. The gas generants comprise a fuel such as 5-aminotetrazole, an oxidizer such as strontium nitrate and/or sodium nitrate, and an inert compound such as clay or silica. However, the gas generants described therein do not autoignite at or below 175° C.

U.S. Pat. No. 4,561,675 granted to Adams et al., which discloses the use of Dupont 3031 single base smokeless powder as an autoignition gas generant, is exemplary of an unreliable known autoignition composition. While such smokeless powder autoignites at approximately 177° C. (≈350° F.), it is largely composed of nitrocellulose. One of ordinary skill in the propellant field will appreciate that nitrocellulose is not stable for long periods at high ambient temperatures and is thus unreliable as an autoignition compound. Moreover, smokeless powder autoignites by a different mechanism than the compositions of the instant invention.

In addition, commonly assigned U.S. Pat. No. 5,084,118 to Poole describes other autoignition compositions, which comprise 5-aminotetrazole, potassium or sodium chlorate, and 2,4-dinitrophenylhydrazine. While the compositions disclosed in U.S. Pat. No. 5,084,118 autoignite and cause ignition of the gas generant when heated to approximately 177° C. (≈350° F.), the compositions have not proven to be fully satisfactory due to oversensitivity to shock or impact, while also being difficult and hazardous to manufacture. Difficulty in manufacture is further compounded because the Department of Transportation (DOT) classifies these compositions as Class A or Class 1.1 explosives and, as such, regulations require special facilities for manufacturing and storage.

SUMMARY OF THE INVENTION

The present invention solves the aforementioned problems by providing an autoignition composition that also functions as a combination autoignition-booster-gas generant within a single chemical charge. An autoignition oxidizer consisting of an alkali metal nitrite combined with a booster oxidizer consisting of an alkaline earth metal nitrate or nitrite forms an oxidizer component. The oxidizer component is mixed with a fuel, such as 5-aminotetrazole (5AT), thereby providing a gas generant with an autoignition temperature less than or equal to 175° C. Mixing the alkali metal nitrite with the high nitrogen fuel creates a higher reactivity at lower temperatures, thereby lowering the autoignition temperature and facilitating the use of a lightweight pressure vessel within the passenger restraint system. Although ignitable at a reduced temperature, the composition passes all high temperature aging tests with a thermal stability at temperatures up to 110° C. In addition, the selected compositions are safer to handle and produce minimal noxious gases such as carbon monoxide or nitrogen oxides.

DETAILED DESCRIPTION OF THE PREFERRED EMBODIMENT(S)

Figure 1:
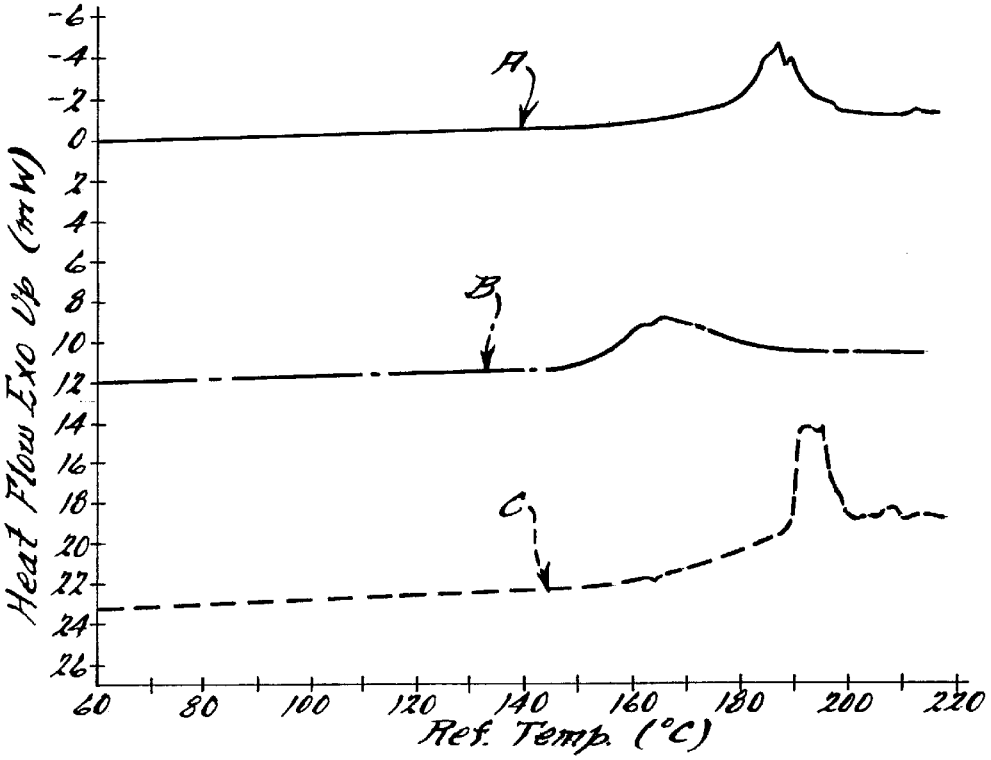
FIG. 1 is a DSC graphical representation illustrating the exothermic decomposition and autoignition of compositions comprising an alkali metal nitrite, in accordance with the present invention.

In accordance with the present invention, an autoignition composition is provided that includes a fuel, a booster oxidizer, an autoignition oxidizer, and an optional inert component.

A fuel is selected from a group consisting of tetrazoles such as 1H-tetrazole, 5-aminotetrazole, 5-nitrotetrazole, 5-nitroaminotetrazole, 5,5'-bitetrazole, diguanidinium-5,5'-azotetrazolate, salts of tetrazoles, triazoles such as nitroaminotriazole, 3-nitro-1,2,4-triazole, 3-nitro-1,2,4-triazole-5-one, salts of triazoles, and mixtures thereof. The preferred fuel is 5-aminotetrazole (5AT) because it is readily available in a pure form at a relatively low cost. The fuel generally comprises 28 to 40% by weight of the autoignition compound.

A booster oxidizer is selected from the group consisting of alkaline earth metal nitrates, alkaline earth metal nitrites, and mixtures thereof. The preferred booster oxidizer is strontium nitrate because it is also readily available in pure form at a relatively low cost. Furthermore, strontium nitrate forms an easily filterable slag upon combustion. The booster oxidizer generally comprises 18 to 64% by weight of the autoignition compound.

An autoignition oxidizer is selected from the group consisting of alkali metal nitrites. Sodium nitrite is preferred due to its low melting point. The most preferred autoignition oxidizer is sodium nitrite because of its high reactivity at low temperatures when combined with the above fuel component or components. The autoignition oxidizer generally comprises 1 to 30% by weight of the autoignition compound.

Finally, an optional inert component is selected from the group including clay, diatomaceous earth, talc, silica, and alumina. Multifunctional bentonite clay is a preferred inert component because it can desensitize the composition, act as a binder to provide greater strength to the final form of the autoignition material, and aid in slag filterability by forming alkali metal and alkaline earth metal silicates and aluminates. The inert component generally comprises 0 to 20% by weight of the autoignition compound.

An autoignition composition used in a vehicle occupant restraint system must be thermally stable up to 110° C. and must rapidly autoignite at temperatures sufficiently low to prevent rupture of the pressure vessel and yet provide normal deployment of the inflator.

5AT melts at 205° C. whereas $NaNO_2$ melts at 271° C. However, when the two are blended together, the combination begins to melt and decompose endothermically between 136° and 146° C., exhibiting a depressed melting point typical of solid-solid mixtures. In accordance with the present invention, the depressed melting point is followed by exothermic decomposition beginning somewhere between 151° C. and 156° C. At this point, the exact temperature at which autoignition begins to occur is dependent upon the energy required to activate a self-propagating reaction, as well as heat transfer through and away from the unreacted material.

The temperature at which exothermic decomposition begins to occur is dependent upon the choice of fuel and autoignition oxidizer, and is specifically related to the melting or decomposition temperatures of the individual components. The ratios of autoignition oxidizer to booster oxidizer, and of autoignition oxidizer to inert material, are directly related to the temperature at which autoignition occurs in the compositions of the present invention. It should be noted that the sensitivity of a composition of the present invention to both shock and impact increases as the relative amount of autoignition oxidizer increases.

By maintaining an autoignition temperature at or below 175° C., the pressure generated during deployment is correspondingly kept to a minimum thereby permitting the use of a lightweight pressure vessel. Maintaining the autoignition temperature below the melting point of the primary gas generant prevents detonation or rapid deflagration of the primary gas generant.

Due to the nature of the selected fuel(s) and oxidizer(s), and due to the absence of a carbon or nitrogen containing binder, the compositions of the present invention when ignited, produce little or no toxic gases such as carbon monoxide or nitrogen oxides. Furthermore, the compositions of the present invention can be formulated to be oxygen deficient (higher CO and lower $NO_x$) or oxygen rich (lower CO and higher $NO_x$). This is measured by the oxygen balance of the composition, which is the percent by weight of molecular oxygen in the composition which is needed (negative oxygen balance) or liberated (positive oxygen balance), to result in a stoichiometric reaction of the composition ingredients thereby forming nitrogen, carbon dioxide, water, and the most common oxides of other elements present.

Because of changing requirements on CO and $NO_x$ in vehicle passenger-restraint systems, it is highly desirable that an autoignition composition be utilized in which the oxygen balance can be easily tailored to meet individual customer requirements, and yet still retain a lower autoignition temperature. The preferred oxygen balance of the compositions of the present invention is between −3.0% and 1.0% by weight. The most preferred oxygen balance is between −2.0% and 0.0% by weight.

The mechanism that leads to autoignition in the present invention occurs with as little as 1.0% by weight of an alkali metal nitrite autoignition oxidizer. Although somewhat desirable, if an alkali metal nitrite is the only oxidizer, an excessively high burn rate will result leading to possible detonation or rapid deflagration if a minimum mass is autoignited under confinement in an inflator. Example 6, given below, is illustrative. It is equally well known that the bulk of undesirable water-soluble particulate produced by both azide and nonazide inflators are alkali metal solids that come from the combustion of compounds containing alkali metals.

Because only a low level of an alkali metal nitrite is necessary to activate the autoignition in the compositions of the present invention, an alkaline earth nitrate or nitrite can be used in combination as a more stable booster oxidizer. In the present invention, because of the extensive use of alkaline metal nitrates and nitrites as the booster oxidizer, the burn rate of the compositions can be decreased to a safe level while still retaining autoignition at a significantly reduced temperature. Furthermore, by using alkaline earth nitrates and nitrites as a major constituent of the oxidizer, water soluble particulate is minimized.

In general, the preferred embodiment is utilized as an autoignition-booster in conjunction with a primary gas generant, thereby alleviating the need for a separate booster charge. However, the compositions of the present invention generate gas at levels similar to common nonazide gas generants or approximately 2.4 moles of gas per 100 grams of generant. Thus, because the present invention achieves results like those produced by nonazide generants disclosed in commonly owned U.S. Pat. No. 5,139,588 to Poole, the autoignition composition can actually function as a combination autoignition-booster-primary gas generant in an inflator system. If desired, the autoignition composition may also be utilized as a separate autoignition component in conjunction with separate booster and separate primary gas generant components.

The compositions of the present invention contain no individually explosive components and are therefore relatively insensitive to shock and impact thereby simplifying processing methods and raw material handling procedures.

Figure 2:
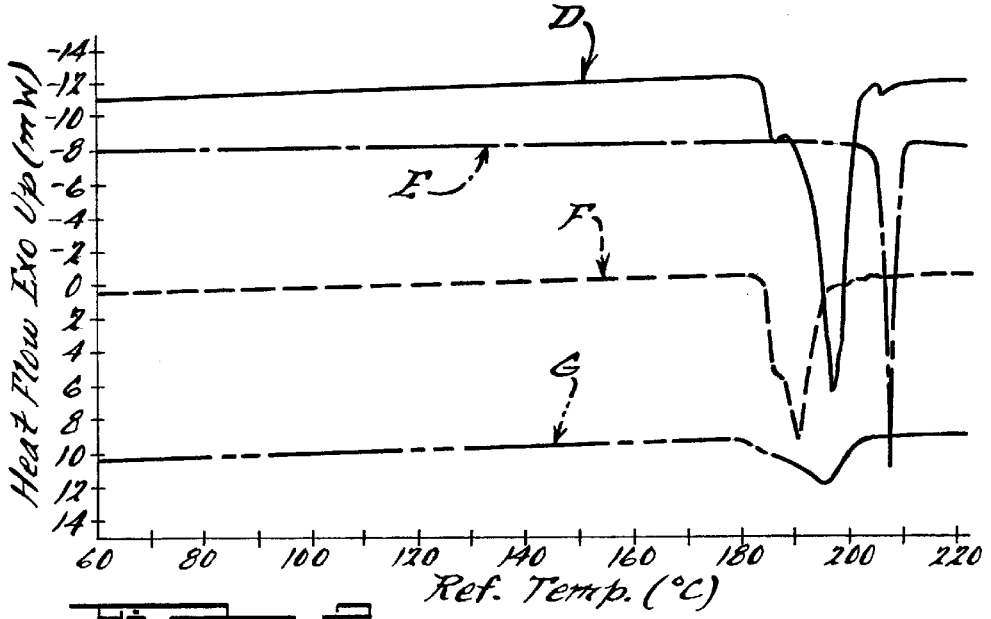
FIG. 2 is a DSC graphical representation illustrating the endothermic decomposition of compositions described in the related art.

FIGS. 1 and 2 were generated using a differential scanning calorimeter (DSC). A downward peak indicates an endothermic process (melting or endothermic decomposition) while an upward peak indicates an exothermic process (ignition or exothermic decomposition). Table 1 correlates the curves of FIGS. 1 and 2 with the respective compositions found in the related art and with those described in the examples given below.

TABLE 1

| Curve | A | B | C | D | E | F | G |
|---|---|---|---|---|---|---|---|
| 5-AT wt % | 37.0 | 35.0 | 33.3 | 37.4 | 32.8 | 34.4 | 33.6 |
| $Sr(NO_3)_2$ wt % | 53.0 | | 47.6 | 52.6 | 57.2 | 37.6 | 47.4 |
| $NaNO_3$ wt % | | | | 10.0 | | 18.0 | 9.0 |
| $NaNO_2$ wt % | 10.0 | 65.0 | 9.0 | | | | |
| Clay wt % | | | 10.1 | | 10.0 | | 10.0 |
| $SiO_2$ wt % | | | | | | 10.0 | |

TABLE 1-continued

| Curve | A | B | C | D | E | F | G |
|---|---|---|---|---|---|---|---|
| U.S. Pat. No. 5,035,757 | | | | | x | x | x |
| U.S. Pat. No. 5,139,588 | | | | x | x | x | x |
| Example 3 | x | | | | | | |
| Example 4 | | | x | | | | |
| Example 6 | | x | | | | | |
| Autoign. Temp. ≦ 175° C. | yes | yes | yes | no | no | no | no |
| Autoign. Temp. Trial 1 | 152° C. | 118° C. | 167° C. | | | | |
| Autoign. Temp. Trial 2 | 161° C. | 141° C. | 175° C. | | | | |
| Autoign. Temp. Trial 3 | 165° C. | 140° C. | | | | | |

In accordance with the present invention and as clearly shown in Table 1, the addition of an alkali metal nitrite such as sodium nitrite reduces the autoignition temperature within a given gas generant composition. On the other hand, compositions not incorporating an alkali metal nitrite do not exhibit exothermic reactions culminating in an autoignition temperature below 175° C.

The autoignition temperatures given in Table 1 were measured using the aluminum fixture described in Example 3. All individual components used in the present invention decompose endothermically, unlike commonly used oxidizers such as chlorates and perchlorates that decompose exothermically. Nevertheless, in accordance with the present invention and as shown in FIG. 1, when an alkali metal nitrite is combined with a fuel and booster oxidizer as described above, an exothermic reaction gives rise to autoignition at or below 175° C. In contrast, as given in Table 1 and as shown in FIG. 2, many similar compositions described in the referenced art will only generate endothermic reactions that do not result in autoignition at temperatures below 220° C.

The Tammann temperature is used to describe the temperature at which there is enough vibrational freedom in the lattice of an inorganic oxidizer to allow for intimate mixing with a mobile, reactive fuel. This is considered to be the temperature at which a self-sustaining reaction is likely to occur with minimal energy input, and is quite low for most alkali metal nitrites, chlorates, and perchlorates. Of particular interest are common oxidizers such as sodium nitrite and potassium chlorate, which have Tammann temperatures of −1° C. and 42° C. respectively.

Although certain alkali metal nitrites have a lower Tammann temperature than common alkali metal chlorates and perchlorates, the decomposition of the disclosed oxidizers are not exothermic as with chlorates. Therefore, a small amount of energy, such as that provided from an impact or electrostatic discharge may activate a reaction, but is less likely to cause a self-propagating reaction due to the nature of the individual components, specifically the oxidizers that decompose endothermically rather than exothermically, in accordance with the present invention.

The present invention is illustrated by the following representative examples. All compositions are given in percent by weight.

EXAMPLE 1

A mixture of 51.9% strontium nitrate $Sr(NO_3)_2$, 36.4% 5-aminotetrazole (5AT), and 11.7% sodium nitrite ($NaNO_2$)

was prepared. Each component was dried and ground separately and then mixed by dry-blending. The composition was tested on a differential scanning calorimeter (DSC) at a heating rate of 10° C. per minute. Endothermic decomposition occurred with an onset at 137° C. and a peak at 142° C. Exothermic decomposition followed immediately, with an initial onset at 154° C. and a peak at 183° C. The onset of a given peak from a DSC scan is defined here as the intersection of the tangent to the baseline and the tangent at the maximum slope of the peak in question.

EXAMPLE 2

A mixture of 42.7% $Sr(NO_3)_2$, 36.9% 5AT, and 20.4% $NaNO_2$ was prepared and tested as described in example 1. Endothermic decomposition occurred with an onset at 136° C. and a peak of 142° C. Exothermic decomposition followed immediately, with an initial onset at 154° C. and a peak at 180° C. This example demonstrates that the amount of $NaNO_2$ present does not significantly effect the mechanism which causes autoignition in the present invention.

EXAMPLE 3

A mixture of 53.0% $Sr(NO_3)_2$, 37.0% 5AT, and 10.0% $NaNO_2$ was prepared and tested as described in example 1. Exothermic decomposition occurred with an onset at 156° C. and a peak at 183° C. Impact sensitivity was tested using a standard Bureau of Explosives Impact Machine consisting of an eight pound weight dropped from a given height. The impact sensitivity of a composition as defined here is the minimum drop height at which initiation occurs in two of two tests. The impact sensitivity of this composition was found to be 3 inches, with complete combustion of the sample. Autoignition was tested using an aluminum fixture containing a small amount of composition (70–100 mg) and a temperature probe. The fixture was placed on a hot plate and heated at a given rate until autoignition occurred, at which point the temperature was measured. When heated at a rate of approximately 15° C. per minute, this composition ignited vigorously at temperatures of 152° C., 161° C., and 165° C. in three separate tests.

EXAMPLE 4

A mixture of 47.6% $Sr(NO_3)_2$, 33.3% 5AT, 9.0% $NaNO_2$, and 10.1% bentonite clay (Volclay HPM-20) was prepared and tested as described in examples 1 and 3. Exothermic decomposition occurred with an onset at 153° C. and a peak of 194° C. The impact sensitivity of this composition was found to be 15 inches. When heated at approximately 30° C. per minute, this composition ignited at 167° C. and 175° C. in two separate tests. This example demonstrates the use of an inert binder and coolant as a desensitizer in the compositions of the present invention.

EXAMPLE 5

A mixture of 45.0% $Sr(NO_3)_2$, 35.0% 5AT, 15.0% $NaNO_2$, and 5.0% bentonite clay was prepared and tested as described in examples 1 and 3. Exothermic decomposition occurred with an onset at 156° C. and a peak at 182° C. The impact sensitivity of this composition was found to be 4 inches, although an audible report or flame was not observed until a drop height of 10 inches. In three autoignition tests, this composition appeared to melt at approximately 146° C. and ignited vigorously at 160° C. when heated at about 10° C. per minute. This example demonstrates the use of clay in small amounts as a desensitizer does not affect the autoignition of the present invention.

EXAMPLE 6

Comparative Example

A mixture of 65.0% $NaNO_2$ and 35.0% 5AT was prepared and tested as described in examples 1 and 3. Exothermic decomposition occurred with an onset at 151° C. and a peak at 166° C. Autoignition was tested three times at a heating rate of approximately 20° C. per minute. In the first two tests, vigorous ignition occurred at 118° C. and 141° C. In the third test the powder was slightly tamped and detonation occurred at 140° C. This example demonstrates the importance of using an alkaline earth nitrate or nitrite as the primary booster oxidizer.

The invention is further exemplified by an autoignition composition for a gas generator of a vehicle occupant restraint system, autoignitable at or below 175° C., the composition comprising a mixture of:

from about 1% to 30% autoignition oxidizer components from the group consisting of alkali metal nitrites, said percentages stated by weight of said mixture;

from 0% to about 20% by weight inert component(s) selected from a group comprising clay, diatomaceous earth, talc, silica, and alumina, said percentages stated by weight of said mixture;

a fuel component(s) selected from the group consisting of tetrazoles, salts of tetrazoles, triazoles, salts of triazoles, and mixtures thereof; and a booster oxidizer selected from the group consisting of alkaline earth nitrates and nitrites, and mixtures thereof, said fuel component(s) and said booster oxidizer selected at levels such that the oxygen balance of the overall composition is between −3.0% to 1.0%, with the proviso that said autoignition composition does not in weight percent contain about 22 to 36% 5-aminotetrazole, about 38 to 62% strontium nitrate, and about 2 to 18% clay or 2 to 18% silica.

While the preferred embodiment of the invention has been disclosed, it should be appreciated that the invention is susceptible of modification without departing from the scope of the following claims.

We claim:

1. A gas generant composition consisting essentially of a mixture of:

about 1% to 30% of a first oxidizer selected from the group consisting of alkali metal nitrites;

about 0% to 20% of an inert component selected from the group consisting of clay, diatomaceous earth, talc, silica, and alumina;

about 28% to 40% of a fuel component(s) selected from the group consisting of 1H-tetrazole, 5-aminotetrazole, 5-nitrotetrazole, 5-nitroaminotetrazole, 5,5'-bitetrazole, diguanidinium-5,5'-azotetrazolate, 3-nitro-1,2,4-triazole, 3-nitro-1,2,4-triazole-5-one, and salts and mixtures thereof; and about 18% to 64% of a second oxidizer selected from the group consisting of alkaline earth nitrates and nitrites, and mixtures thereof, wherein said percentages are stated by weight of said mixture and said gas generant composition autoignites at or below 175° C.

2. An autoignition composition as claimed in claim 1 wherein:

said fuel component is 5-aminotetrazole at about 28% to 40% by weight of said mixture; and said second oxidizer is strontium nitrate at about 18% to 64% by weight of said mixture.

3. An autoignition composition as claimed in claim 2 wherein:

said fuel component is about 33% to 37% by weight of said mixture; and said second oxidizer is about 42% to 53% by weight of said mixture.

4. An autoignition composition as claimed in claim 3 wherein:

said second oxidizer is about 52% strontium nitrate, said fuel component is about 36% 5-aminotetrazole, and said first oxidizer is about 12% sodium nitrite, said percentages stated by weight of said mixture.

5. An autoignition composition as claimed in claim 3 wherein:

said second oxidizer is about 43% strontium nitrate, said fuel component is about 37% 5-aminotetrazole, and said first oxidizer is about 20% sodium nitrite, said percentages stated by weight of said mixture.

6. An autoignition composition as claimed in claim 3 wherein:

said second oxidizer is about 53% strontium nitrate, said fuel component is about 37% 5-aminotetrazole, and said first oxidizer is about 10% sodium nitrite, said percentages stated by weight of said mixture.

* * * * *